US006421627B1

(12) United States Patent
Ericsson

(10) Patent No.: US 6,421,627 B1
(45) Date of Patent: Jul. 16, 2002

(54) DEVICE AND METHOD FOR DETERMINING THE POSITION OF A WORKING PART

(75) Inventor: Lars Ericsson, Täby (SE)

(73) Assignee: Spectra Precision AB, Danderyd (SE)

( * ) Notice: Subject to any disclaimer, the term of this patent is extended or adjusted under 35 U.S.C. 154(b) by 0 days.

(21) Appl. No.: 09/341,102

(22) PCT Filed: Nov. 27, 1998

(86) PCT No.: PCT/SE98/02168

§ 371 (c)(1),
(2), (4) Date: Aug. 18, 1999

(87) PCT Pub. No.: WO99/28566

PCT Pub. Date: Jun. 10, 1999

(30) Foreign Application Priority Data

Nov. 28, 1997 (SE) ..... 9704397

(51) Int. Cl.[7] ..... G01C 11/26
(52) U.S. Cl. ..... 702/150; 356/139.05
(58) Field of Search ..... 702/150, 152, 702/127, 94, 153, 159; 33/281, 286, 290, 370, 624, 707; 356/3.01, 6.04, 6.13, 6.06, 138, 139.05

(56) References Cited

U.S. PATENT DOCUMENTS 4,630,685 A * 12/1986 Huck et al. ..... 172/7
4,677,555 A * 6/1987 Goyet ..... 701/50
5,438,771 A * 8/1995 Sahm et al. ..... 37/348
5,442,169 A * 8/1995 Kunz ..... 250/227.21
5,748,148 A * 5/1998 Heisner et al. ..... 342/457
6,171,018 B1 * 1/2001 Ohtomo et al. ..... 404/84.5

FOREIGN PATENT DOCUMENTS

EP 0 811 727 A1 12/1997 ..... E02F/3/24
WO WO 4/01812 1/1994 ..... G05D/1/10

* cited by examiner

*Primary Examiner*—Marc S. Hoff
*Assistant Examiner*—Edward Raymond
(74) *Attorney, Agent, or Firm*—Connolly Bove Lodge & Hutz LLP

(57) ABSTRACT

The invention relates to a device and to a method for determining the position for a working part of a tool on a working machine. A position determining apparatus is placed in a defined position on the working machine in order to determine the position of this place in a coordinate system fixed in space. The position-determining apparatus comprises partly a relatively slow determining device (1, 4; 1, 4*a*, 4*b*; 53, 50, 51), which at time intervals measures the actual position of the machine , and partly a relatively fast determining device (6; ACC1, ACC2) which reacts on position changes of the machine in order to calculate and up date the determination between the said time intervals.

28 Claims, 3 Drawing Sheets

DEVICE AND METHOD FOR DETERMINING THE POSITION OF A WORKING PART

Figure 1:
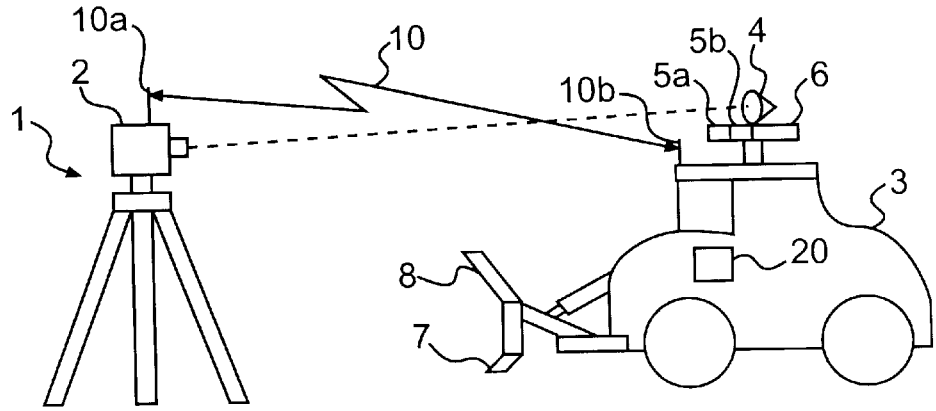

The present invention relates to a device of the type stated in the introduction to claim 1, and a method of the type which is stated in the introduction to claim 13. The invention concerns particularly the controlling of an industrial machine, for example a ground-leveling machine, crane, dredger or the like.

BACKGROUND TO THE INVENTION

During road construction or the leveling of ground, for example for buildings, parks or playgrounds, vehicle displays or the like, ground preparation machines are used which are to give a predetermined topography to the piece of ground through, on one hand digging and on the other hand piling up material.

It is important in this connection that the working tools on the machines which are used can be accurately controlled to the exact right working level in the intended section. The control should preferably even be able to be remote-controlled automatically so that the desired topography in the right position inside a section should be able to be written into a computer programme and information concerning suitable processing should be able to be given continuously and automatically to the driver of the vehicle. It should also, in the cases where it is possible, be able to have automatic controlling of the machines in order to perform certain work completely automatically.

This implies that for ground-working equipment one needs to keep track of the exact position in space of the working tools' positions in space, the angular position in both horizontal and vertical directions and their working directions.

DESCRIPTION OF RELATED ART

U.S. Pat. No. 4,807,131 (Clegg Engineering) describes a ground preparing system with the use of an instrument with a horizontal plane-identifying rotating sweeping beam, and a height indicator placed on a ground-preparing machine, for hitting by the sweeping beam. The height indicator is placed directly onto the working tool of the machine, for example on the blade of an excavator. Furthermore, a separate position generator can be placed on the machine and cooperate with an electronic distance: measuring instrument in order to give the position of the machine in the region which is to be treated. The signals from the different above-mentioned indicators are fed to a computer, which is given information on the desired topography of the region of ground via predetermnined, composite data, and which compiles measuring values and gives indication for controlling the working tool of the machine.

To determine the orientation and inclination via machine movements is a slow method. Likewise, position- and height-determination with the aid of GPS-technique or with electronic angular and distance measuring often is not sufficiently fast in order to be able to measure the position and, above all, the height with sufficient accuracy during fast displacements.

OBJECTS OF THE INVENTION

One object of the invention is to provide a control resp. a control indication for a ground-preparing machine, which makes possible adequate control of the machine with so few as possible measuring units placed outside the machine.

Yet another object is to provide an instantaneous, continuous and correct position and direction indication of a ground-preparing machine during work, even during fast movements.

Another object of the invention is to produce controlling of a ground-preparing machine, where that which is important is the indication of working position and working direction of the working part of the machine tools but where the influence of the vibrations of the working part, unfavourable environment, obscured positions etc. are removed.

A further object of the invention is to provide a direct position-determining and an automatic following of the working portion of the machine's working part during the working operation.

A further object of the invention is to provide a flexible system which is usable for measuring of the instantaneous working position and the working direction for different types of working machines, e.g. ground-preparing machines, digging machines, cranes, etc.

SUMMARY OF THE INVENTION

The above mentioned objects are obtained with a device which has the features stated in the characterizing part of claim 1. Further characteristics and developments are stated in the other claims.

The invention is characterized in that the position- and orientation-determining apparatus can comprise, on one hand, a relatively slow, accurate determining device, which at time intervals accurately measures the current position and orientation of the machine, and on the other hand a fast determining device, which reacts on position and/or orientation changes in order to calculate and update the calculation between said time intervals. This fast determination device in this case only has to be stable for short periods of time because a slow drift is corrected through updating from the slower device.

The relatively slow, accurate position and orientation determination can take place with the help of a stationary measuring station, for example a geodesic instrument with automatic target-following or a radio navigation system, for example GPS (Global Positioning System) placed in the vicinity of the working machine for position-determining in cooperation with the detector device. The inclination can also be determined e.g. by inclinometers and the orientation around the vertical axis e.g. by compass or by a north-seeking gyro.

The short time-period-stable determining device can thereby comprise an accelerometer device on the machine for measuring the acceleration of the machine in at least one direction, preferably in several mutually different directions, whereby the calculation unit double-integrates the indicated acceleration or accelerations and updates the latest calculated result of the position in the fixed coordinate system.

When a quick determination of a change of orientation is needed. preferably a further accelerometer or a gyro is used for each axis around which rotation is to be determined. The signals from these sensors are used, after suitable integration and conversion from the coordinate system of the machine to a fixed coordinate system, to update the position-determninations for the machine in the fixed coordinate system. A suitable way of putting together the information from the slow and the fast sensors in an optimal manner is to use Kalmann filtering.

Preferably, measuring and calculation are continuously performed at intervals while the machine is in operation. The calculating unit calculates after each measuring the position, and possibly the direction of working and the speed of working, of the working part of the tool, using the latest and earlier calculation results for the position. The calculating unit can also use earlier calculation results in order to predict the probable placement, orientation, direction of working and speed, a certain time in advance for the working part of the working machine.

ADVANTAGES OF THE INVENTION

By the invention a measuring system has been produced which is easy to use and which furthermore is relatively cheap. Already existing stations for measuring a region can be used for controlling the working machines. This means that special equipment for the stations does not need to be bought or transported to the working place, especially for use with the invention. However, extra equipment is needed on the working machine.

SHORT DESCRIPTION OF THE FIGURES

Figure 2:
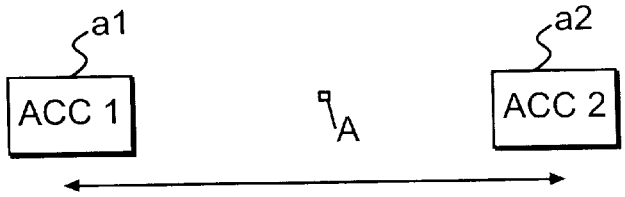
Figure 3:
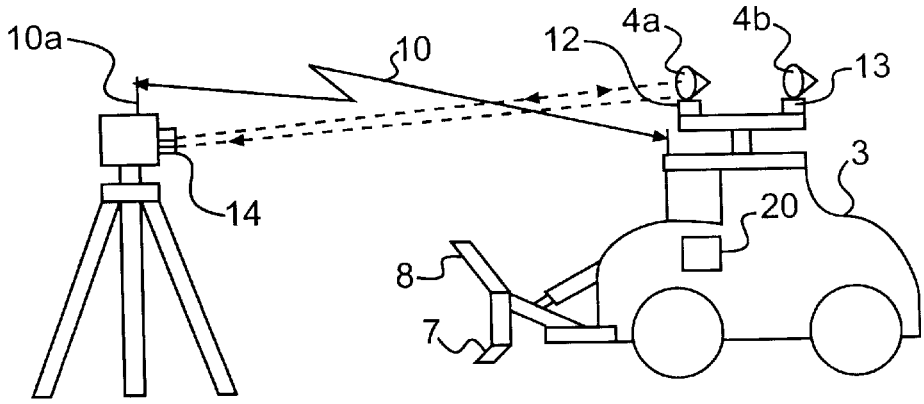
Figure 4:
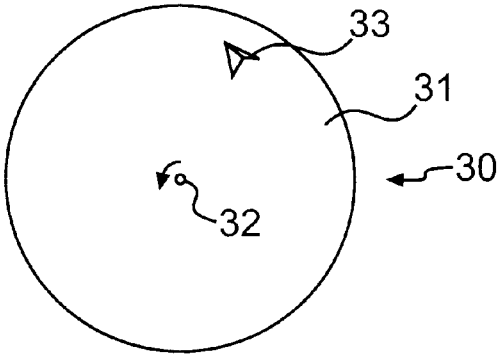
Figure 8:
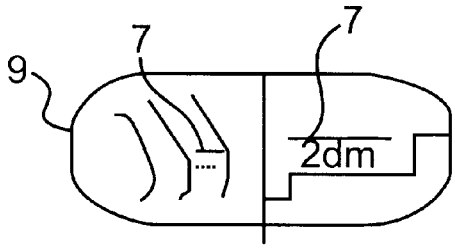
Figure 5A:
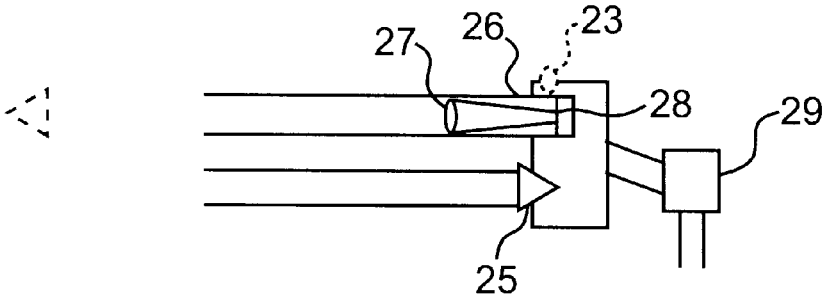
Figure 5B:
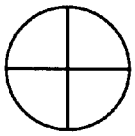
Figure 5C:
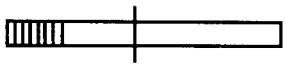
Figure 6:
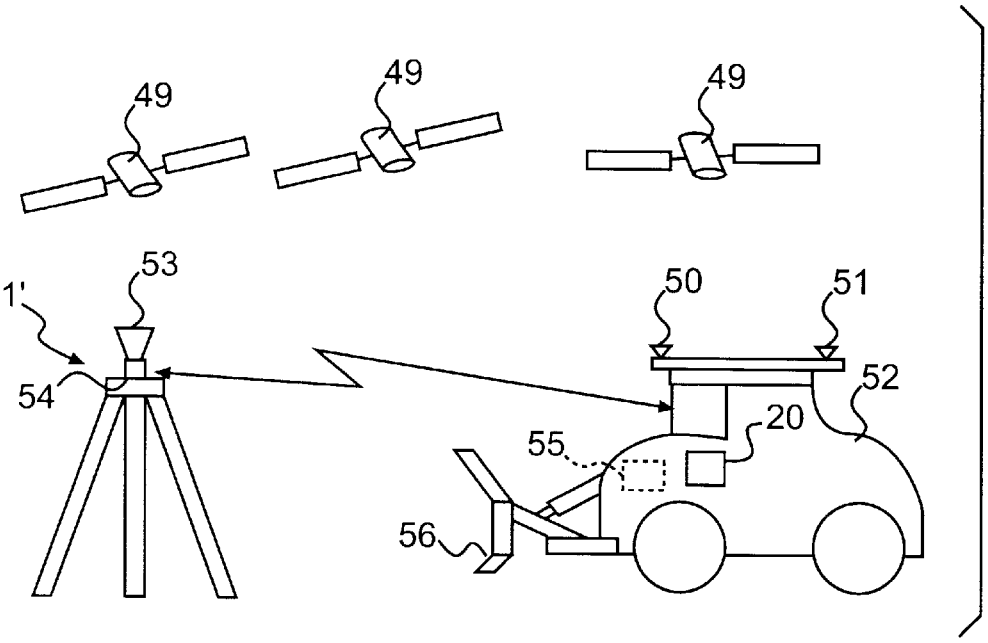
Figure 7:
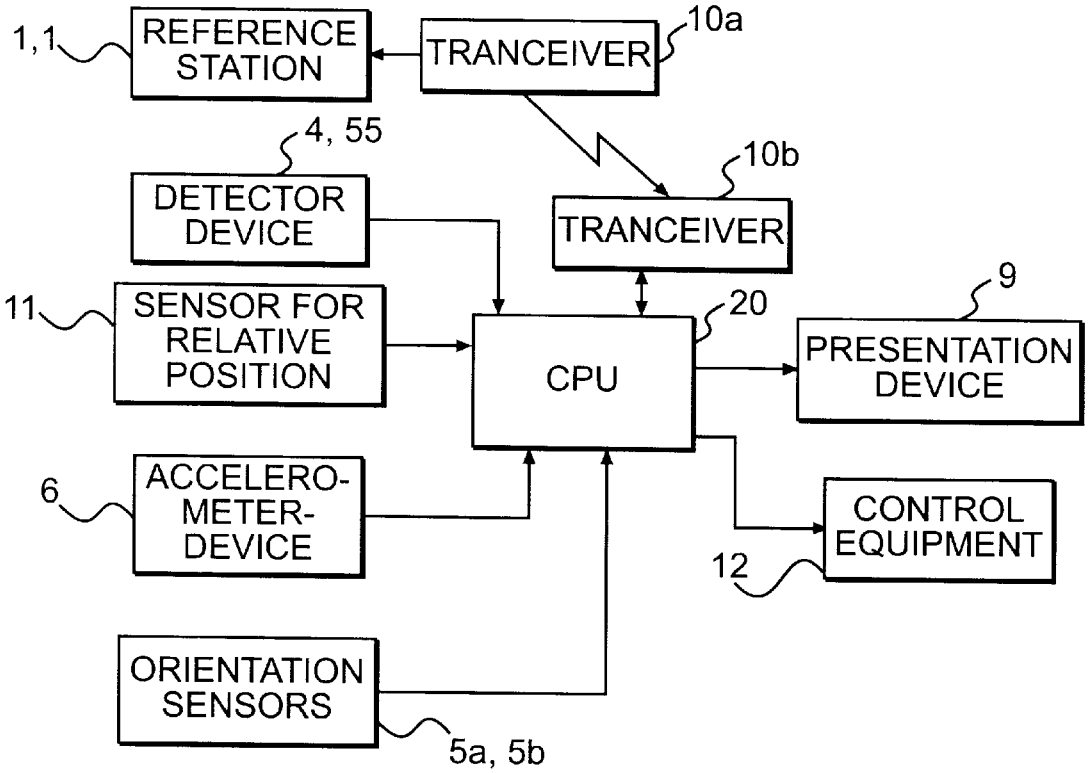

The invention is described more closely below with reference to the accompanying drawings, where FIG. 1 shows schematically an excavator with a first embodiment of a measuring system according to the invention, FIG. 2 shows a block diagram of an accelerometer device, FIG. 3 shows a second embodiment of a system according to the invention, FIG. 4 shows an embodiment of the position of a reflector on the excavator in FIG. 3, FIG. 5A shows an embodiment of a detector unit used in the measuring system according to the invention, FIG. 5B shows a first embodiment of a detector for the device in FIG. 5A, FIG. 5C shows a second embodiment of a detector for the device in FIG. 5A, FIG. 6 shows schematically an excavator with a third embodiment of a measuring system according to the invention, FIG. 7 shows a block diagram for a complete measuring system according to the invention, FIG. 8 shows a picture on a screen in the control cabin of the excavator.

DETAILED DESCRIPTION OF THE DIFFERENT EMBODIMENTS OF THE INVENTION

Embodiment 1:

According to the embodiment shown in FIG. 1, a geodesic instrument I is set up on a ground area which is to be treated. The instrument 1 is, for example, an electronic distance-measuring instrument 2 with an integrated distance and angular measurement of the type which is called a total station and which is marketed by SPECTRA PRECISION AB, i.e. with combined advanced electronic and computer techniques. The position and the horizontal angular position of the instrument 1 is first measured in the common way well-known for the skilled man. This can, for example, be performed through measuring against points in the region with predetermined positions, e.g. church towers or the like.

A geodesic instrument gives both the distance as well as the vertical and horizontal direction towards a target, whereby the distance is measured against a reflector, e.g. of the comer cube type. A geodesic instrument is furthermore provided with a computer with writeable information for measurings to be performed and for storing of data obtained during the measurings. Preferably an unmanned geodesic instrument is used for the invention, which means that the instrument automatically searches and locks onto and follows an intended target, which can be made of the same reflector which is used for the distance measuring or some other active target as described later. The geodesic instrument calculates the position of a target in a fixed ground-based coordinate system.

A working machine in the form of a ground-preparing machine, e.g. a ground scraper machine, is, for the slower, accurate position measuring in this embodiment, provided with a reflector unit 4, e.g. a corner cube prism in a placement on the machine which is well visible from the geodesic instrument 1, no matter how the machine twists and turns, on the roof of the machine in this case, and with an orientation-determining unit 5*a*,5*b* and a device 6 comprising at least one accelerometer for acceleration-sensing and possibly a further accelerometer or a gyro unit for sensing rotation. A corner cube prism reflects back an incident beam in the opposite direction even if the angle of incidence to it is relatively oblique. It is important that the reflector unit 4 does not point a non-reflecting side towards the instrument 1. It should therefore preferably consist of a set of comer cube prisms placed in a circle around an axis.

The orientation of the machine in a fixed coordinate system in this embodiment is determined by the units 5*a*,5*b*, which for example contain two inclination sensors 5*a* for determining the inclination towards a vertical axis in two perpendicular directions and an electronic compass or a north-seeking gyro 5*b* for determining the orientation in a fixed coordinate system, for example in relation to north.

It is important that the system can follow fast courses of events, as the machine during its work can tip if it rides up on a rock or down into a dip. A possibility for a short-tern-stable, accurate and rapid determination of position and orientation changes in the machine-based coordinate system, for subsequent conversion to the fixed coordinate system, should therefore be provided. With such a possibility the position and direction changes can be determined in the interval between the slower position and orientation determination of the machine via the total station.

Therefore the accelerometer device 6 is placed on the machine for indicating rapid movements. This device 6 should preferably sense fast movements and rotation of the machine in different directions, in order to give satisfactory functioning. A minimum requirement is, however, that the device senses the acceleration along an axis of the machine, and in this case preferably its normal vertical axis (z-axis) because the requirement for accuracy normally is greatest in this direction, where the intention of the ground preparation normally is to provide a certain working level in the vertical direction. Preferably, however, the device 6 should sense acceleration and/or rotation in relation to three different axes of the machine.

The acceleration measurers can be of any conventional type whatsoever and are not described and exemplified in more detail, because they are not part of the actual invention. Their output signals are double integrated with respect to time in order to give a position change. This can take place in the unit 6 or in a computer unit 20 (see FIG. 8). The calculated position changes are given in the coordinate system of the machine but are converted then to the fixed coordinate system. so that the move-ments of the machine in the fixed coordinate system all the time are those which are continuously shown. These indications take place with such short intervals which are suitable for the control system used.

The geodesic instrument 1 can give absolute determination of the position of the reflector unit in the fixed coordinate system with a time interval of approximately 0.2–1 sec., wherein data from the device 6 supports the measuring system there-between.

The ground-working part 7, i.e. the scraper part of the scraper blade 8 of the machine 3, is that which actually should be indicated in the fixed coordinate system with respect to position, rotation in horizontal and vertical directions and also preferably with respect to its direction of movement and speed of movement.

The machine's own positional relationship sensor (not shown) gives a basis for calculating the instantaneous position of the scraper part 7 in the coordinate system of the machine. Sensing, and calculation of the instantaneous setting of the scraper blade in relation to the machine with geometric calculations are well-known arts and there do not need to be described more closely.

The combination of information from the different sensors to a final position and orientation in the fixed coordinate system suitably takes place in the main computer 20. A suitable method for obtaining an optimal combination of the information from the different sensors for determining the actual position and orientation is the use of Kalmann filtering.

FIG. 2 shows schematically an accelerometer device 6 for sensing along an axis of the machine and with rotation-sensing around a perpendicular axis. In this way the accelerations $a_1$ and $a_2$, are sensed with the accelerometer ACC1 and ACC2. By combining these two measured values and with knowledge of the distance d between the accelerometers, rotation and acceleration of some selected point (A) can be calculated. Through using three similar sets, the acceleration along and the rotation around three axes can naturally be determined. As an alternative or complement, the rotational changes around one or more axes can be determined with the help of gyros.

Embodiment 2:

The ground-preparation machine 3 in FIG. 3 is, for the slow, accurate orientation determination around the vertical axis, in this embodiment provided with two reflector units 4*a* and 4*b* in a placement on the machine which is easily visible from the geodesic instrument 1. In the embodiment according to FIG. 3 they are placed with an essentially fixed placement in relation to each other and the machine. The possibility of having the reflectors movable between different "fixed" positions, in order to obtain a suitable orientation in relation to the measuring instrument, is obvious. Each of them should preferably consist of a set of corner cube prisms placed in circle around an axis.

The machine's three-dimensional placement and orientation in a fixed, or in relation to the measuring instrument defined coordinate system is measured through the measurement towards the reflector units 4*a* and 4*b*, which have a precise or determinable placement in the coordinate system of the machine. By determining the positions of the reflectors in the fixed coordinate system, then the orientation of the machine in this coordinate system can be determined, which means that the transformation between the coordinate systems is defined.

The reflector units 4*a* and 4*b* in FIG. 3 have each their own sighting indicator 12 and 13, which give direction information for the geodesic instrument as to the target or the reflector to which its instantaneous alignment should be made and for measuring against this target. The sighting indicator can be of different types; it is only important that it automatically aligns the geodesic instrument to the measuring reflector which for the moment is to serve as the target for the measurement.

The alignment indicators are, however, in the embodiment shown in FIG. 3, light elements, preferably provided with a special modulation and wavelength character which is separable from the environmental light, and are shown here placed under their respective target reflectors and preferably so that their light can be seen from all directions. The geodesic instrument 1 is thereby suitably provided, under the distance measurer 2 itself, with a seek and setting unit 14, which seeks a light signal, having the same modulation and wavelength character as the light elements. Each one of the alignment indicators 12 and 13 can suitably consist of several light elements arranged in a circle in the same way as the reflectors, in order to cover a large horizontal angle.

The light elements in 12 and 13 are lit alternatingly with each other in such a rate that the seek and setting unit 14 manages to set its alignment towards the light of the light elements, and measuring of distance and alignment to its associated targets is able to be performed. The measuring is performed in sequence towards the two reflector units 4*a* and 4*b*.

Alternatively, three (or more) reflector units with light elements can be placed in predetermined positions on the machine, whereby measuring towards these targets with calculations gives position, alignment and orientation of the machine in a three-dimensional fixed coordinate system.

FIG. 4 shows another embodiment of a target unit 30, towards which the geodesic instrument 1 can measure in order to obtain position data for the machine 3. The target unit comprises in this case a disc 31, which rotates around an axis 32 normal to the disc. A target, here in the form of a reflector 33, e.g. a ring of reflectors of the comer cube type, is mounted near the periphery of the disc 31. What is important with this embodiment is that the reflector 33 rotates around an axis 32, wherefore it instead can be mounted on a rotating arm (not shown). The detector unit 33 shaped as a reflector is consequently movable between positions with determinable posi-tions in relation to the working machine, and an indicating unit, e.g. an encoder (not shown), continuously indicates the position. A further alternative way of determining the orientation of the machine is to use a servo-controlled optical unit which automatically aligns with the geodesic instrument. With e.g. an encoder, the alignment of the optical unit can be read in the coordinate system of the machine. An embodiment thereof is shown in FIGS. 5A–5C. At least one servo-controlled optical unit 26–29 aligns itself with the geodesic instrument. In this case the optical unit is built together with the reflector, which gives the advantage that it can consist of a simple prism and not a circle of prisms. The units can, however, also be separated. For the optical unit it is appropriate to use the measuring beam of the geodesic instrument or a beam parallel with this.

In the embodiment shown in FIG. 5A the optical unit 26 is placed beside the reflector 25 shown in section. The optical unit consists of a lens or a lens system 27 and a position-sensitive detector 28. The lens/lens system focuses the measuring beam on the detector 28, which for example is a quadrant detector as is shown in FIG. 5B. The geodesic measuring beam of the instrument 1 can thereby be used also for the alignment device if the beam is sufficiently wide. Alternatively, and from the technical point of view, preferably, the instrument is, however, provided with an extra light source, e.g. a laser, which towards the unit 26–28 transmits a narrow light beam, which in this case can have a completely different character, for example another wavelength, than the measuring beam transmitted towards reflector 25, and is parallel with and arranged at the same distance from the measuring beam as the centre line of the tube 26 from the centre line of the reflector 25.

A third alternative is to place a comer cube prism for alignment of the reference station (not shown) and a light source 23 (drawn with dashed lines) up against the optical unit (26–28). In this case a reflected beam is obtained from the prism which is focused on the quadrant detector when the optical unit is correctly aligned to the station.

With the use of a quadrant detector 28 the servo-control can take place such that the subdetectors will have so similar illumination as possible. Such detectors are known in themselves, equally their use in different types of servo-control arrangements 29, and therefore are not described more closely. The optical unit is movably and controllably mounted on the machine and possibly integrated with the reflector. Through the servo-control of the servo-motors (not shown) the optical unit is aligned so that the signals from the detector 28 are balanced, which means that the unit is orientated in the direction of the measuring beam. The alignment in relation to the working machine can be read, for example with some kind of encoder, or with some other type of sensing of the instantaneous setting positions of the guided servo-motors.

The above alignment can occur in both horizontal and vertical directions, but the complexity is reduced considerably if it is limited to guidance in the horizontal direction. This is often sufficient when the inclination of the machine normally is minor in relation to the normal plane. In such a case the detecting can be performed with the help of a detector, elongated in the transverse direction, and a cylinder lens which collects the radiation within a certain vertical angular region to the detector. Because FIG. 5A shows a cross-section, it also corresponds with this embodiment. The detector can be made of, for example, a one-dimensional row of elements of e.g. CCD-type, as is shown in FIG. 5C.

Information on the direction from the geodesic instrument to the position detector, which is given by the geodesic instrument, together with the encoder reading which gives the orientation of the machine in relation to the geodesic instrument consequently gives the orientation of the machine in a fixed coordinate system.

The servo-control of the target reflector means that information is continuously received about the alignment of the vehicle in relation to the geodesic instrument 1.

Embodiment 3:

In the above-described embodiments the position measuring has occurred through measuring against one or more targets on the measuring object from a geodesic instrument 1. Position-measuring can also occur with the help of radio navigation, e.g. GPS (Global Position System), by placing one or more radio navigation antennae on the measuring object and one on a stationary station to one side.

In the embodiment shown in FIG. 6 there is a radio navigation antenna 50, which here is shown receiving signals from a number of GPS-satellites 49, at the periphery of a rotating disc 51 on the upper part of an excavator 52. The position of the antenna is indicated in a radio navigation receiver 55 in at least two predetermined rotational positions of the disc 51 in relation to the excavator 52. The disc rotates so slowly that the antenna position in each rotational position can be indicated with accuracy but still so fast that normal movements of the excavator do not significantly influence the measuring result.

A reference station 1' with another radio navigation antenna 53 with receiver 54 is mounted on a station which is placed at a predetermined position outdoors with a known position somewhat to the side of the ground which is to be treated. A differential position determination is obtained through radio transfers between the radio navigation receiver 54 and the calculating unit 20 in the machine 52. The instantaneous position of the machine is calculated with so-called RTK-measuring (Real Time Kinematic). A calculation of this type is in itself well-known and does not need to be described mere closely.

The only difference to earlier embodiments is that the position determination against the target(s) is made with GPS-technology instead of through measuring with a total station. For the rest, the orientation determination and determination of fast displacements and rotations takes place in the same way as described in earlier embodiments.

Common Block Diagram

FIG. 7 shows a block diagram according to the invention which is applicable to all the embodiments. It can be pointed out that with position determination with a geodesic instrument, position data for the target is collected in the reference station 1 and transmitted to the machine via radio link, while in the GPS-case it is correction data from the receiver 54 which is transferred from the reference station 1' to the machine and that position data is produced in the calculating unit 20 starting from data from the receivers 54 and 55.

The calculating unit 20 consequently calculates through combining data from the reference station 1 and, in the GPS-case, the receiver 55 together with data from the orientation sensors 5, accelerometer device 6 and sensors for relative position 11, the instantaneous position of the scraper blade in the fixed coordinate system, i.e. converted from the coordinate system of the machine. The sensors for relative position 11 can for example be encoders or potentiometer sensors connected to the links which join the working part of the machine. The calculating unit 20 is preferably placed in the machine.

The desired ground preparation in the fixed coordinate system is programmed into either the computer 20 of the geodesic instrument 1 or preferably of the machine 3. This is equipped with a presentation unit 9, preferably a screen, which presents to the operator of the machine (not shown), on one hand, how the machine 3 and its scraper blade 8 are to be manoeuvred based on its instantaneous existing position and, on the other hand, its instantaneous deviation from the desired manoeuvring. Alternatively and preferably an automatic guidance of the working part to the intended height and orientation is performed with the help of the control equipment 12 consisting of, for example, hydraulic manoeuvring means which are controlled by the unit 20.

The machine operator must occasionally deviate from the closest working pattern because of obstacles of various types, such as stones or the like, which are not included in the geodesic instrument's programmed map of the desired structure of the ground preparation region.

It is also possible to show a programmed map of the desired preparation and of the existing position and direction of movement of the scraper part 7 on the map. The information between the geodesic instrument 1 and the machine 3 can be sent wirelessly in both directions, as is shown by the zigzag connection 10. The computer in one or the other of these units can be chosen to be the main computer which performs the important calculations usable for the work of the machine 3 with the scraper blade, but preferably this is done in the unit 20. The most important here is that the calculation of the position and orientation of the scraper blade is performed in the fixed coordinate system, no matter where it is, that the geodesic instrument and electronic units in the machine have data-transferring connections with each other, and that the machine operator is given an easily understood presentation of what is to be done and what is finished.

FIG. 8 shows an example of a picture which can be presented to the machine operator on the presentation unit 9. A picture of a scraper blade with an alignment mark is superimposed on a map with the desired profile of the ground preparation region, wherein the picture of the scraper blade moves over the map as working progresses. The presentation unit 9 can be split and can also show a profile picture with the scraper blade placed vertically over or under the desired ground level and with the height difference with respect to this being given.

The actual ground level does not need to be shown. However, it can be suitable to show parts of the ground with the desired height clearly in the picture to the machine operator so that he knows where to perform his work. In this case it is possible to have a function, which gives parts of the ground with a small difference within a predetermined tolerance level between the actual and the desired level, a predetermined colour e.g. green.

It is also possible, e.g. as shown with dashed lines in the map, to show a shadow picture of the scraper blade in order to indicate that it has not yet arrived at the right level. In this case it looks like the scraper blade is hovering over the ground and the machine operator obtains a clear indication of how deep the machine must scrape in order to get the shadow picture to unite with the picture of the scraper blade. It is suitable in the invention that the desired levels for the ground preparation which are shown on the map, wherefore it is the position of the shadow picture which indicates where the scraper blade 7 is in the normal to the plane of the map. In this connection it is of no interest to show the actual ground structure on the map.

Calculation of position and rotation of the machine both in vertical and horizontal direction is performed in the fixed coordinate system as well as subsequent calculation of the instantaneous position and rotation angles of the scraper blade after conversion from the coordinate system of the machine to the fixed coordinate System. Subsequently there follows a new sequence with the same measurements and calculations with subsequent calculation of the scraper blade's displacement from the previous measurement, whereby the direction and speed of the blade are obtained and presented on the presentation unit 9.

These measurement sequences are repeated during the machine's scraper work, whereby the machine operator the whole time during the working progress obtains instantaneous data concerning the scraper blade's position, alignment, direction of displacement and speed in the fixed coordinate system, and consequently obtains an extremely good idea of how the work is progressing compared to the desired ground preparation, and how the machine is to be manoeuvred.

The geodesic instrument can only perform its alignments and measurements in a relatively slow speed in the fixed coordinate system. The accelerometer device is used in order to update the measuring results in the intermediate times. A special advantage of this updating function between the upgrades with the geodesic instrument is that, because the measurement towards the two measurement targets 4*a* and 4*b* in FIG. 3 cannot be performed simultaneously, it is possible, with the updating, to achieve that the delay between the sequential measurements towards the reflectors can be compensated for.

Through the machine's direction of displacement and speed being calculated continuously, it is also convenient to calculate a predicted position and orientation for both the machine and the working part a certain time in advance. based on earlier calculating data. How such calculations are performed with the help of the latest and earlier calculated data is obvious for the skilled person and is therefore not described more closely.

Many modifications of the embodiments shown are possible within the scope which is given by the accompanying claims. It is consequently possible to have mixed designs with both prisms and radio navigation antennae as position detector units. For example, the position and rotation alignment of a geodesic instrument can be determined with the help of one or more radio navigation antennae, for example one on the geodesic instrument and one at a distance from this. Other types of working machines than those shown, where one wants to have continuous information on position, angular position and direction of work during working progress, such as e.g. cranes, dredges or the like, are extremely suitable to be provided with the invention. Each stated calculation unit is suitably a computer or a subroutine in a computer, as is common nowadays.

What is claimed is:

1. A system for determining the position of a working part of a tool on a working machine, comprising:

means placed on a preselected location of the working machine to determine the position of the working machine in a coordinate system fixed in space and having a) means for measuring the actual position of the machine between sequential time intervals at a first rate, and b) means for reacting to positional changes of the machine at a second rate, faster than the first rate;

means for sensing positional changes of the working part relative to the machine during the sequential time intervals; and means for calculating the position of the working part in the coordinate system.

2. The system according to claim 1, wherein the reacting means comprises at least one accelerometer mounted on the machine and connected to the position determining means for measuring the acceleration of the machine in at least one direction, the position determining means performing integration of acceleration and updates calculations of the machine position in the fixed coordinate system.

3. The system according to claim 1 wherein the reacting means comprises at least one rotation sensing device for rotation around at least one axis of the machine.

4. The system according to claim 1 wherein the actual position measuring means comprises a stationary measuring station placed in the vicinity of the working machine and at least one detector means located on a preselected point on the working machine and communicating with the stationary measuring station for determining the position of the machine in the fixed coordinate system.

5. The system according to claim 1 together with orientation means mounted to the machine and outputting data, at the first rate, the data relating to the orientation in the fixed coordinate system of the part of the machine where the orientation means is mounted.

6. The system according to claim 1 wherein the actual position measuring means comprises a stationary measuring station placed in the vicinity of the working machine and at least two fixed detector units with fixed positions on the working machine.

7. The system according to claim 1 wherein the actual position measuring means comprises a stationary measuring stat on placed in the vicinity of the working machine and a movable detector unit movable between at least two positions determinable relative to the working machine.

8. The system according to claim 1 together with at least one rotatably mounted and controllable optical unit placed on the working machine, which optical unit aligns itself towards the stationary measuring station with the help of a measuring beam of a stationary station.

9. The system according to claim 4 together with at least one rotatably mounted and controllable optical unit placed on the working machine, which optical unit aligns itself towards the stationary measuring station with the help of a measuring beam transmitted from the optical unit and reflected in a prism in the stationary station, whereby the orientation of the optical unit relative to the working machine is indicated and transmitted to the calculating means.

10. The system according to claim 1 wherein the position-determining means comprises geodesic target seeking means placed at a predetermined distance from the working machine and permitting measurements to a reflector target mounted on the working machine.

11. The system according to claim 10, wherein each target is provided with an alignment indicator means for furnishing alignment indications for the geodesic target seeking means relating to the target.

12. The system according to claim 4 wherein the position determining detector means is a radio navigation antenna connected to a receiver.

13. The system according to claim 1 wherein the calculating means calculates the probable future position, orientation, working direction and speed for the working part of the working machine.

14. The system according to claim 1 wherein the calculating means stores a map with the desired topography of an area which is to be treated, and calculated data for the working part is displayed for positions relative to the map on a presentation unit.

15. A method for determining the position of a working part of a tool on a working machine, comprising the steps:

determining the position of the working machine in a coordinate system fixed in space by a) measuring the actual position of the machine between sequential time interval at a first rate, and b) reacting to positional changes of the machine at a second rate, faster than the first rate;

sensing positional changes of the working part relative to the machine during the sequential time intervals; and calculating the position of the working part in the coordinate system.

16. The method according to claim 15 wherein the reacting to positional changes comprises: measuring the acceleration of the machine in at least one direction;

integrating acceleration measurements; and updating calculations of the machine position in the fixed coordinate system.

17. The method set forth in claim according to claim 15 wherein the reacting step comprises sensing rotation around at least one axis of the machine.

18. The method according to claim 15 wherein the actual position measuring comprises:

placing a stationary measuring station in the vicinity of the working machine; placing at least one detector on a preselected point on the working machine; and communicating with the stationary measuring station for determining the position of the machine in the fixed coordinate system.

19. The method according to claim 15 together with the step of outputting data, at the first rate, the data relating to the orientation in the fixed coordinate system of the part of the machine where the orientation means is mounted.

20. The method according to claim 15 wherein the step of measuring actual position further comprises:

placing a stationary measuring station in the vicinity of the working machine; and placing at least two fixed detector units with fixed positions on the working machine.

21. The method according to claim 15 wherein the step of measuring actual position further comprises: placing a stationary measuring station placed in the vicinity of the working machine; and placing a movable detector unit movable between at least two positions determinable relative to the working machine.

22. The method according to claim 15 together with the step of mounting at least one rotatable controllable optical unit on the working machine, and self-aligning the optical unit towards the stationary measuring station in response to a measuring beam of a stationary station.

23. The method according to claim 15 together with the step of mounting at least one rotatable controllable optical unit on the working machine, and self-aligning the optical unit towards the stationary measuring station in response to a measuring beam of a stationary station, the beam transmitted from the optical unit and reflected from a prism in a stationary station, whereby the orientation of the optical unit relative to the working machine is indicated and transmitted to the calculating means.

24. The method according to claim 15 wherein the step of determining position comprises the step of placing a geodesic target seeking instrument at a predetermined distance from the working machine and taking measurements to a reflector target mounted on the working machine.

25. The method according to claim 15, together with the step of providing each target with an alignment indicator means for furnishing alignment indications for the geodesic instrument relating to the target.

26. The method according to claim 15 wherein the step of determining position further includes the step of obtaining positional data from a radio navigation antenna connected to a receiver.

27. The method according to claim 15 wherein the step of calculating position further includes the step of calculating the probable future position, orientation, working direction and speed for the working part of the working machine.

28. The method according to claim 15 wherein the step of calculating position further comprises the steps of:

storing a map with the desired topography of an area which is to be treated; and displaying calculated data for the working part's positions relative to the map.

* * * * *